United States Patent [19]

Karlsson et al.

[11] 4,333,485

[45] Jun. 8, 1982

[54] WATER-BASED CLEANING SYSTEM

[75] Inventors: Tom O. B. Karlsson, Floda; Hans M. Larsson, Göteborg, both of Sweden

[73] Assignee: Nordnero AB, Kungalv, Sweden

[21] Appl. No.: 165,025

[22] Filed: Jul. 1, 1980

[30] Foreign Application Priority Data

Jul. 3, 1979 [SE] Sweden ..... 7905806

[51] Int. Cl.[3] ..... B08B 3/12

[52] U.S. Cl. ..... 134/60; 134/111; 134/184

[58] Field of Search ..... 134/60, 184, 111

[56] References Cited

U.S. PATENT DOCUMENTS 2,949,119 8/1960 Smith ..... 134/60

3,872,015 3/1975 Madsen ..... 210/433.2 X

FOREIGN PATENT DOCUMENTS 54-112562 9/1979 Japan ..... 134/184

*Primary Examiner*—Robert L. Bleutge

*Attorney, Agent, or Firm*—Laff, Whitesel, Conte & Saret

[57] ABSTRACT

The invention relates to a cleaning system in which, during the cleaning procedure, the articles have to pass a plurality of treatment stations in a direction which is opposite to that in which the flow of the cleaning liquid is established. From the first and most contaminated of the treatment stations, the cleaning liquid is removed and supplied to an ultrafilter. At least part of the outflow from this filter is returned to one of the latest or to the last treatment station. Ultrasonic energy is used to increase the efficiency of at least one of the stations. Ambient heat and vapor loss are recaptured.

3 Claims, 1 Drawing Figure

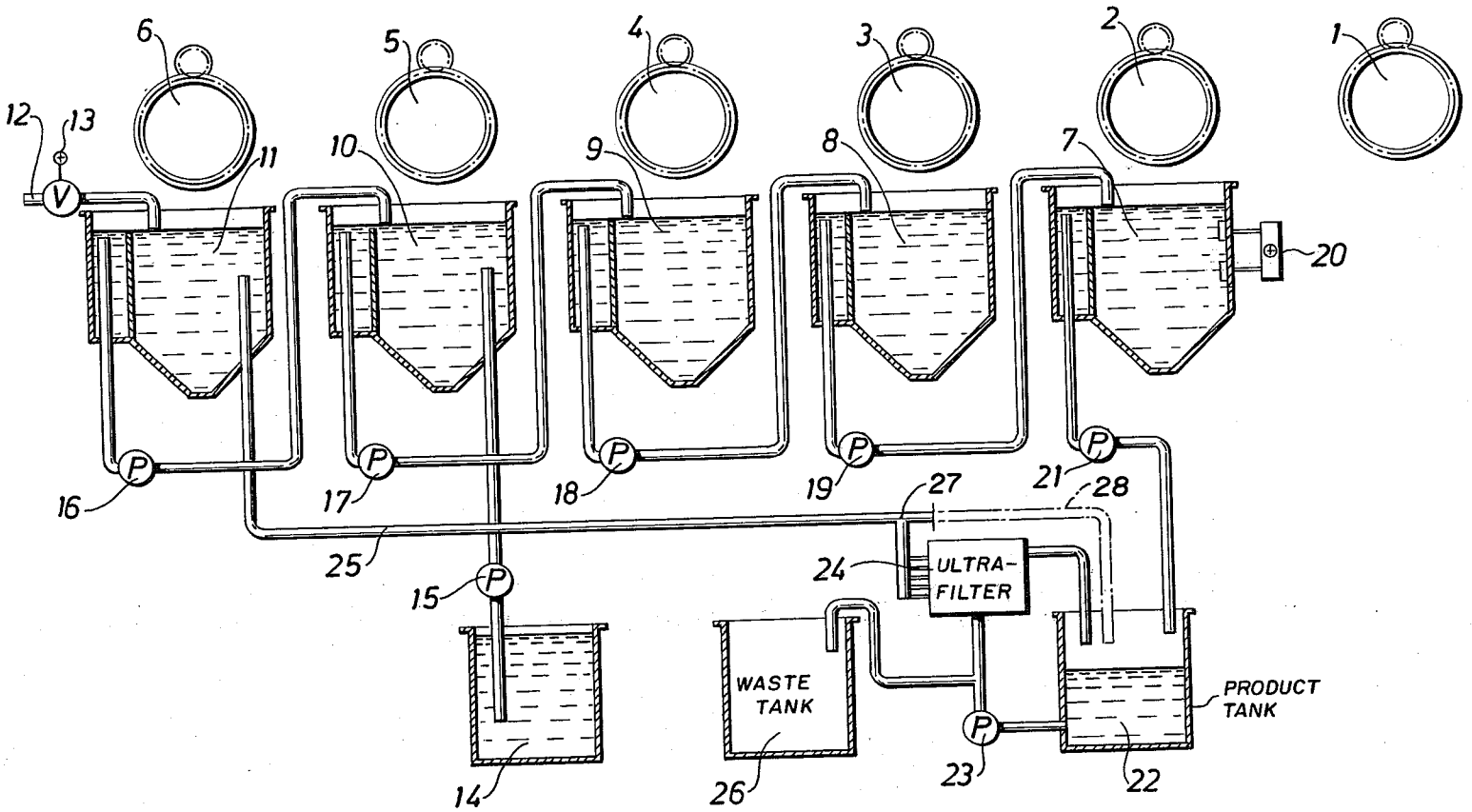
PRODUCT TANK
ULTRA-FILTER
WASTE TANK
1
2
3
4
5
6
7
8
9
10
11
12
13
14
15
16
17
18
19
20
21
22
23
24
25
26
27
28

WATER-BASED CLEANING SYSTEM

This invention relates to water-based cleaning systems for cleaning and degreasing articles immersed in sequential baths and, more particularly, to energy-conserving systems.

During the inventive cleaning procedure, the articles have to pass through a plurality of treatment stations, with article movement in a direction which is opposite to the direction in which the cleaning liquid flows. Thus, the first treatment station for the articles is the last and most downstream station for the flowing cleaning liquid.

Conventional cleaning systems use a multi-station processing bath and succeeding rinsing baths. The contaminants which are removed, such as oil and other impurities, are successively concentrated in the processing bath. During the time while any bath liquid is being utilized, it will have a varying amount of contaminants, beginning with none at a first tank and ending with exhausted fluids at a final tank, thereby giving an uneven treatment result. This unevenness of the treatment often leads to overcompensation, so that an unnecessary overly good result is achieved. However, this means that there is an increased consumption of chemicals caused by the transfer of large quantities of non-utilized chemicals to the rinsing water. The chemicals are diluted there and the contaminants are very difficult to remove. The cleaning apparatus is thus overloaded, involving risks and possible troubles.

The energy consumption of these conventional degreasing and cleaning process systems are often comparatively high because bath temperatures are elevated in order to bring about a faster intrusion of the cleaning agent and a better dissolving of the contaminants. This means that there is a great energy consumption, especially through vapor losses from the bath surfaces and through the heating of the articles being treated. The heat which the articles absorb is transferred immediately afterward to the rinsing water, which thereby receives a non-usable, moderate increase of its temperature. This progressive heating of large quantities of rinsing water is a waste of energy.

The resulting vapor loss requires a considerable amount of ventilating air, due to working environment requirements. Increased ventilation further increases the vapor losses and often results in an over-ventilation of the entire working premises, thereby causing further heat losses.

An object of the present invention is to provide a cleaning system which eliminates the disadvantages of the above-described conventional systems. The purpose of the invention is to bring about a more even treatment of the cleaned articles and to control the collection and concentration of waste.

Another object of the invention is to eliminate a substantial amount of the energy losses which are mentioned above.

The invention has the characteristics defined in the claims found at the end of this specification.

The invention will be described in connection with the attached drawing, which schematically shows a multi-station cleaning system, functioning according to the invention.

The drawing includes a plurality of article-carrying cassettes 1–6 for transporting any suitable number of parts to be processed and a plurality of tanks 7–11 containing the treatment baths and forming the treatment stations. The cassettes carrying the articles are moved from the right to the left, and are successively lowered into each of these tanks 7–11. Thus, all of the cassettes 1–6 are moved step by step in the same right-to-left direction. As here shown, the cassette 1 is intended to show a position for loading and unloading articles. If tanks and cassettes are used with a carousel form of loading and unloading, each cassette is both loaded and unloaded at the same position.

Water and chemicals are automatically supplied to the tanks, as required. Water is supplied through a pipeline 12 to the tank 11 via a stop valve 13. The chemicals are supplied from a chemical tank 14 through a pump 15 to the tank 10. A pump 16 transfers cleaning liquid from the tank 11 to the tank 10. Pump 17 transfers the cleaning liquid from the tank 10 to the tank 9. From the tank 9, cleaning liquid is transferred through pump 18 to the tank 8. From the tank 8, cleaning liquid is transferred through pump 19 to the tank 7. Thus, the cleaning liquid flows in a direction which is opposite to the direction in which the cassettes carrying the articles are moved.

The cleaning liquid is water to which chemicals are added. The chemical content is held at a relatively small percentage. This ability to use such a small proportion of chemicals eliminates the need for additional rinsing and provides a moderate cleaning effect. On the other hand, there is a large cleaning effect, which is caused by an ultrasonic transducer 20, which is usually used to ultrasonically energize the liquid in tank 7 in combination with an increased bath temperature. This ultrasonic transducer 20 is positioned at the tank 7. The cleaning effect is further enhanced by a succeeding treatment of the articles in the following baths, which are also coupled in counter-flow.

In general, all of these baths have the same proportion of chemicals. The ultrasonic apparatus 20 causes an effective dissolving of oil and other impurities from the articles, also with only a relatively small proportion of chemicals.

A pump 21 transfers contaminated liquid from the tank 7 to a product tank 22, from which the liquid is pumped at 23 to an ultrafilter 24. The outflow from this filter 24 has such a small proportion of contaminants that it can be supplied, with good effect, through a pipeline 25 to one of the last treatment stations. In the present example, the last treatment station is tank 11. This filtration procedure takes place at the same time that a new cleaning agent is being supplied from the chemical tank 14 to the tank 10.

The outflow from filter 24 is also used to cause the counter-flow of the cleaning liquid. More particularly, at the conduit "T" 27, the outflow from ultrafiliter 24 divides between a pipe 28 leading to product tank 22 and another pipe 25 leading to the tank 11. Thus, means are provided for controlling the amount of fluid flowing from the ultrafilter 24 to the treatment stations and to a resupply of the fluid at the input side of the ultrafilter. By returning and controlling part of the filter outflow to the product tank, it is possible to control both the counter-flow and also the quantity of chemicals corresponding to the outflow supplied through the pipeline 25 to the tank 11. The concentration of oil at the ultrafilter 24 is so high that, in many cases, it can be deposited without any cost. The waste is supplied to a waste tank 26.

The inventive system eliminates the disadvantages of conventional systems. The treatment is more even and, at the same time, the waste can be controlled through a continuous collection and concentration.

As mentioned above, the cleaning liquid comprises a relatively neutral aqueous solution having a small content of tensides. This liquid is used in a multi-stage counter-flow similar to that of counter-flow rinsing. Thus, each of the various process stations has, step by step, a lower content of contaminants as the cleaning fluid advances from left to right toward the final tank 7.

The cascade process thereby formed has the unique advantage that the treatment result can be kept constant, with an extremely low consumption of chemicals and a simplified process control. Furthermore, the need for rinsing water is eliminated since the process baths have a considerably smaller content of chemicals and the last process bath has a very small content of contaminants. The small content of contaminants in the last treatment bath means that the preceding treatment baths have a far greater content of contaminants. The most contaminated bath can be ultrafiltered at a moderate cost. The waste is given such a concentrated form, that the cost for its handling can be considerably reduced. Compared with the final requirements mentioned above, the filter outflow received from the ultrafilter contains a small content of oil and other impurities. Without any further treatment, it can be supplied to the last treatment bath.

The invention has an energy cycle which eliminates a great part of the energy losses found in conventional cleaning systems. The inventive system gives a renewal of the cleaning liquid by means of the above-described successive cleaning in cascaded tanks.

Preferably, before entering the wet treatment, the system provides a substantial heating of the articles in the air which carries an energy quantity constituted by an increased temperature and humidity, which starts the cleaning. Conventionally, cleaning systems remove this elevated atmospheric temperature and humidity without using its value.

According to the invention, the air over the tanks is forced to pass around the articles to be cleaned in order to raise them from their original cold or room temperature. Thus, those articles absorb a great deal of the energy content of the air, through convection currents and condensation of humidity. By sealing and reducing building space containing the cleaning equipment, the air quantity can be brought down to a minimum, thereby further increasing the humidity and providing a very high energy content per volume of air. At the same time, a need for supplying other and fresh air for the remainder of the premises is decreased and the need for an over-ventilation of these premises is prevented. It is also possible to use the otherwise wasted heat in the outlet air flow from the device, by prewarming articles prior to treatment in the heat used to dry the cleaned articles.

A considerable saving of energy has also been achieved through ultrafiltering the warm, most contaminated process bath, so that the filter outflow is supplied while it is still warm to a later or to the last process bath.

Those who are skilled in the art will readily perceive how to modify the system. Therefore, the appended claims are to be construed to cover all equivalent structures which fall within the true scope and spirit of the invention.

We claim:

1. A water-based cleaning system comprising a plurality of treatment stations for use during a cleaning procedure, means for transporting articles to be cleaned past said plurality of treatment stations, with movement of said articles being in a first direction, means for causing a cleaning liquid to flow through said stations in a second direction which is opposite to said first direction, means for removing said cleaning liquid from the first treatment station and supplying it to the input side of an ultrafilter means, and means for controlling the amount of said cleaning liquid flowing from the output side of said ultrafilter means, means for dividing said cleaning liquid and for supplying at least a controlled part of said cleaning liquid to one of the last treatment stations and for resupplying at least some of the remainder of said amount of said cleaning liquid to the input side of the ultrafilter means, said control means automatically controlling the flow of said cleaning liquid in said second direction through said treatment stations.

2. The cleaning systems according to claim 1 and means for introducing the outflow of the filter means into the counter-flow of the cleaning liquid.

3. The cleaning system according to claim 1, and ultrasonic means for energizing at least one of the first treatment stations with ultrasonic energy in order to increase the effectiveness of the cleaning procedure.

* * * * *